US009162852B2

(12) United States Patent
Korkiamäki

(10) Patent No.: US 9,162,852 B2
(45) Date of Patent: Oct. 20, 2015

(54) METHOD FOR CONTROLLING A CONCRETE MIX CASTING EQUIPMENT DISMOUNTABLY ATTACHED TO A CRANE AND A CONCRETE MIX CASTING EQUIPMENT DISMOUNTABLY ATTACHED TO A CRANE

(75) Inventor: Pekka Korkiamäki, Toijala (FI)

(73) Assignee: ELEMATIC OYJ, Toijala (FI)

( * ) Notice: Subject to any disclaimer, the term of this patent is extended or adjusted under 35 U.S.C. 154(b) by 578 days.

(21) Appl. No.: 13/446,340

(22) Filed: Apr. 13, 2012

(65) Prior Publication Data

US 2012/0261373 A1 Oct. 18, 2012

(30) Foreign Application Priority Data

Apr. 14, 2011 (FI) ..... 20115361

(51) Int. Cl.
*B66C 13/08* (2006.01)
*B66C 17/06* (2006.01)

(52) U.S. Cl.
CPC ..... *B66C 17/06* (2013.01)

(58) Field of Classification Search
USPC ..... 294/68.22, 68.1, 68.21, 68.24, 68.25; 366/113; 414/191; 212/270, 339
See application file for complete search history.

(56) References Cited

U.S. PATENT DOCUMENTS 934,294 A * 9/1909 Doud ..... 294/68.22
954,480 A * 4/1910 Stuebner ..... 294/68.22
1,306,758 A * 6/1919 Godfrey ..... 294/68.22
1,923,678 A 8/1933 Lowell
2,856,223 A * 10/1958 Weaver ..... 294/68.24
4,172,685 A * 10/1979 Nabeshima et al. ..... 294/81.41
4,360,304 A * 11/1982 Brewer et al. ..... 414/191
4,432,578 A * 2/1984 Garlinghouse ..... 294/68.21
4,668,154 A * 5/1987 Ueno et al. ..... 414/607
5,392,935 A * 2/1995 Kazama et al. ..... 212/94
6,261,043 B1 * 7/2001 Weems et al. ..... 294/68.22

FOREIGN PATENT DOCUMENTS

DE 1801343 A1 5/1969
DE 41 02 795 A1 8/1992
FR 2 676 724 A1 11/1992
GB 1 100 043 A 1/1968
GB 1206413 A 9/1970
JP 55-61594 A 5/1980
JP 59097992 A 6/1984

(Continued)

OTHER PUBLICATIONS

Finnish Search Report dated Feb. 9, 2012.

(Continued)

*Primary Examiner* — Paul T Chin
(74) *Attorney, Agent, or Firm* — Dickinson Wright PLLC

(57) ABSTRACT

A concrete mix casting equipment that can be dismountably attached to a crane, and method for controlling the same, by controlling motion of the casting equipment in the horizontal plane by moving the crane, and by controlling a substantially vertical motion of the casting equipment during the operation of the casting equipment by vertically moving the lifting element of the crane such that this engages the upper part of a lower frame of the casting equipment, thereby moving the lower frame of the casting equipment vertically relative to an upper frame of the casting equipment.

7 Claims, 1 Drawing Sheet

(56) References Cited

FOREIGN PATENT DOCUMENTS

| | | | |
|---|---|---|---|
| JP | H0654457 | U | 7/1994 |
| JP | 8-20014 | A | 1/1996 |
| JP | 2002211883 | A | 7/2002 |
| JP | 2002274779 | A | 9/2002 |

OTHER PUBLICATIONS

EP Appl. No. 12164162.5—European Search Report dated Jul. 12, 2012, 7 pgs.

* cited by examiner

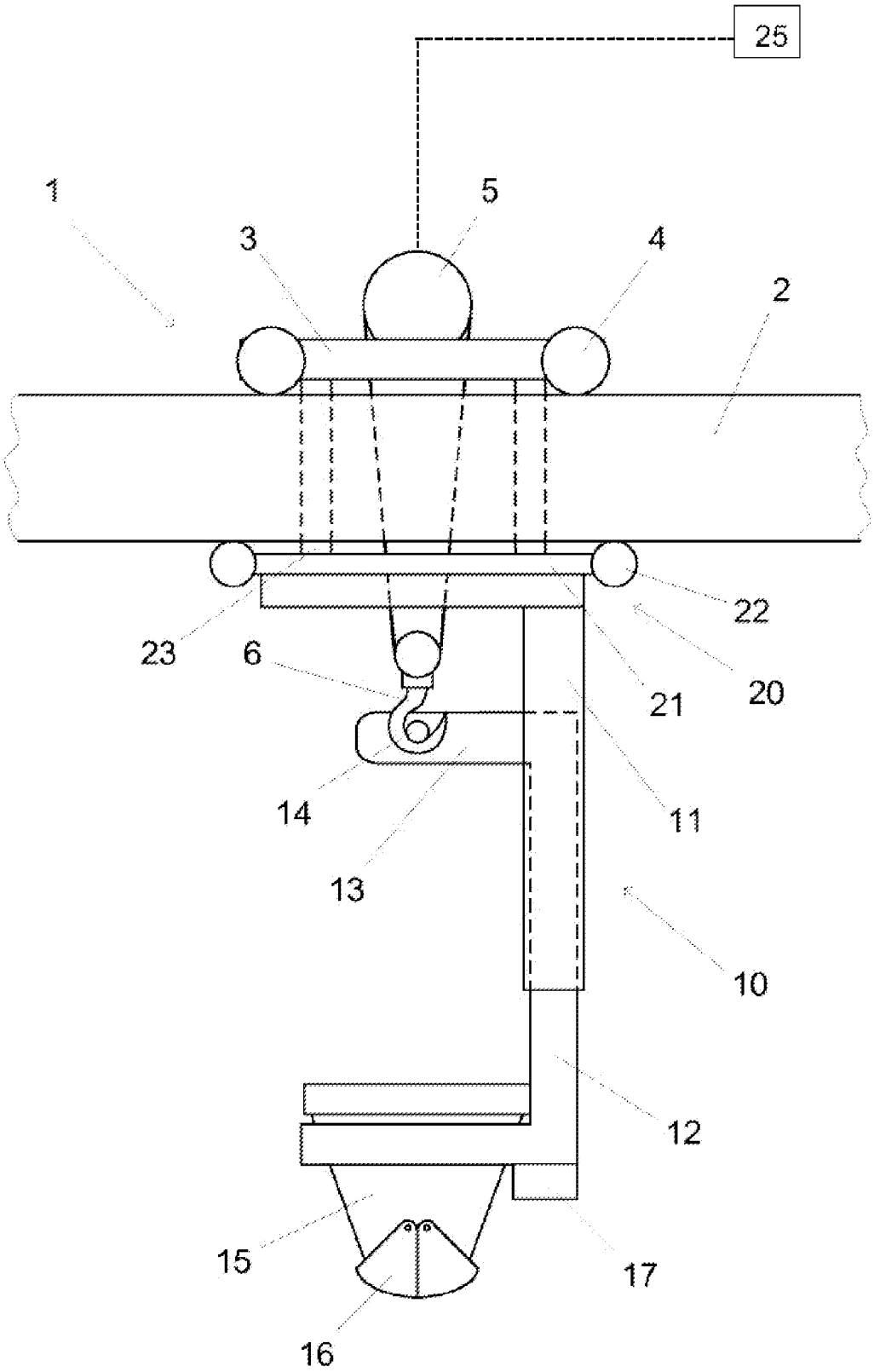
25
1
5
3
4
2
22
23
6
20
21
14
11
13
10
12
15
17
16

METHOD FOR CONTROLLING A CONCRETE MIX CASTING EQUIPMENT DISMOUNTABLY ATTACHED TO A CRANE AND A CONCRETE MIX CASTING EQUIPMENT DISMOUNTABLY ATTACHED TO A CRANE

This application claims benefit of FI 20115361, filed 14 Apr. 2011.

BACKGROUND

1. Field

The disclosure relates to concrete mix casting equipment to be dismountably attached to a crane. More precisely, the disclosure relates to a method for controlling casting equipment to be dismountably attached to a crane particularly in the vertical direction, and to casting equipment to be dismountably attached to a crane and provided with said control system.

2. Description of Related Art

Casting equipment to be dismountably attached to a crane is known from the prior art. Such casting equipment is used for pouring concrete mix to various different molds, such as to horizontal table molds or vertical battery molds. Generally such casting equipment to be attached to a crane is used in element factories which are not provided with separate casting equipment arranged in connection with the molds for conveying the concrete mix to the casting mold.

When necessary, such casting equipment to be attached to a crane can also be used for temporarily raising the production capacity of an element factory.

Nearly all facilities used in element production are provided with at least one crane moving above the manufacturing space, the type of said crane often being a bridge crane, for moving cast elements from molds to storage. Thus the casting equipment to be attached to a crane can be used within a fairly wide area in the element factory.

In the art, casting equipment to be dismountably attached to a crane is set in place by attaching the casting equipment to a bridge crane by intermediation of the hook of the crane, and by lifting the casting equipment up, to the crane carriage, so that the casting equipment is at the top edge set against suitable surfaces of the crane carriage, and thus firmly supported against the crane carriage. By means of said supporting against the crane carriage, there is obtained a stable, non-swinging and firm fastening of the casting equipment to the crane, which keeps the casting equipment in the right position, also when the equipment is moved by intermediation of the crane.

The casting equipment attached to the crane is on the horizontal plane moved by moving the bridge crane along its rails, and by moving the bridge crane carriage. The vertical motion required in the casting equipment for the mix container thereof and for the pouring gate provided therein is created by specific means provided in the casting equipment, said means comprising a vertically sliding fastening of the mix container to the casting equipment, and a motor for vertically moving the mix container.

Because a regular casting machine fastened to a crane is attached to the crane through the crane hook, the vertical lifting capacity of the crane cannot be used for anything else while the casting machine is in operation. In addition, regular casting machines fastened to a crane are heavy in structure and need a considerable amount of energy while the casting machine is in operation. Moreover, a casting machine fastened to a crane is separated from all other possible automatics of the factory, and it is controlled manually, which hinders the controlling of other processes in the factory and causes potential problems, for example in the form of collisions both with other moving process equipment, such as concrete mix transport devices, and with stationary elements in the factory, such as columns and walls in the factory hall.

SUMMARY

In the arrangement according to the present disclosure, a casting machine to be dismountably attached to a crane is fastened and supported by separate means to the crane carriage, so that the lifting means of the crane can be used for vertical adjustments of the casting machine, particularly for vertical adjustments of that part of the casting machine that includes the pouring gate.

By means of this arrangement according to the disclosure, the structure of the casting machine can be made remarkably simpler, which results in material savings and hence savings in general expenses. In addition, the energy consumption of the casting machine itself is remarkably reduced.

In a casting machine control system according to the disclosure, the casting machine control system is combined with the crane control system, so that both the horizontal adjusting of the casting equipment by the crane motions and the vertical adjusting of the casting equipment can be controlled through the casting machine control system. Thus the crane need not be controlled through a separate control system in addition to the casting machine control system, but the unit formed by the crane and the casting machine is controlled through one and the same casting machine control system. Now said uniform control system controls, apart from the motions created through intermediation of the crane, also the opening and closing of the casting machine pouring gate, and the rotating of the casting machine receptable around its axis.

Said casting machine control system, including crane control, can also be automated by automatics connected to the casting machine, so that the automated control can be connected to an even larger automatics system, for instance to the automatics controlling the whole element factory. Thus the control and operation of the casting machine can be optimized with respect to the operation of the rest of the factory, and chances for collisions of the casting equipment can be minimized or possibly eliminated altogether.

In a preferred embodiment of the arrangement according to the disclosure, the crane is a bridge crane, and the crane lifting device is the crane hook, wherein the casting equipment is dismountably attached to the bridge crane carriage.

The concrete mix casting equipment according to the disclosure preferably also comprises a separate auxiliary element attached fixedly to the crane carriage, by intermediation of which the casting equipment is dismountably attached to the crane. Moreover, the fastening of the casting machine to the auxiliary element is advantageously realized by means of suitable quick-lock means, for instance hydraulically operated bolts, in which case the fastening and dismounting of the casting machine is carried out in a fast and simple fashion.

More precisely, the method according to the disclosure relates to a method for controlling concrete mix casting equipment to be dismountably attached to a crane, said casting equipment being controlled on the horizontal plane by moving the crane, characterized in that a substantially vertical motion of the pouring gate of the casting equipment is achieved, during the operation of the casting equipment, by vertical motion of the lifting element of the crane.

The casting equipment according to the disclosure relates to a concrete mix casting equipment to be dismountably attached to a crane, said casting equipment comprising a concrete mix container, a pouring gate for conducting the concrete mix from the container to the casting mold, and means for fastening the casting equipment dismountably to the crane, characterized in that the casting equipment comprises means for connecting that part of the casting equipment that includes the pouring gate to the lifting element of the crane for producing vertical motion of the pouring gate during the operation of the casting equipment.

BRIEF DESCRIPTION OF DRAWING

The invention, in its embodiments, is described in more detail below, by way of example, with reference to the appended drawing, which FIG. 1 is a schematical illustration of concrete mix casting equipment according to the invention to be dismountably attached to a crane.

DETAILED DESCRIPTION OF SPECIFIC EMBODIMENTS

FIG. 1 shows in schematical illustration a bridge crane 1 comprising a bridge formed of two adjacent beams 2, and a carriage 3 moving on top of said bridge, said carriage being moved along the beams 2 supported on wheels 4. The carriage 3 of the bridge crane 1 is provided with a crane motor 5 for vertically shifting the crane lifting element 6, which in the example of FIG. 1 is a lifting hook. The ends of the beams 2 of the bridge crane 1 are placed on rails (not illustrated) that are arranged in a transversal direction with respect to the beams 2. The bridge formed by the beams 2 of the bridge crane 1 is moved along said rails, and the crane carriage 3 is moved along the beams 2.

A casting machine 10 according to an embodiment of the invention is dismountably attached to the carriage 3 of the bridge crane 1, by intermediation of an auxiliary element 20 fixedly attached to the crane carriage 3. Said auxiliary element 20 comprises a planar element 21 forming the fastening surface of the casting machine 10, which planar element 21 is provided with wheels 22 located at both ends of the element and placed against the lower surfaces of the beams 2 of the bridge crane 1. In addition, the auxiliary element 20 includes elongate fastening elements 23 for fastening the auxiliary element, moving along the bottom surface of the beams 2 of the bridge crane 1, to the carriage 3 moving along the top surfaces of the bridge crane beams 2.

The casting machine 10 according to an embodiment of the invention comprises a two-part frame, i.e. an upper frame 11 and a lower frame 12, of which the upper frame 11 is fastened to the lower surface of the planar element 21 of the auxiliary element 20. The lower frame 12 of the casting machine 10 is in turn slidably attached to the upper frame 11. In the example illustrated in the drawing, this sliding attachment of the lower frame 12 to the upper frame 11 is realized by placing the lower frame 12 partly inside the upper frame 11, so that the walls of the lower frame 12 are in the area located inside the upper frame 11 provided with wheels (not illustrated) in order to achieve a sliding joint between the two frames.

The fastening of the upper frame 11 of the casting machine 10 to the auxiliary element 20 can be advantageously realized by various different quick-lock solutions, for instance by hydraulically operated bolts (not illustrated). Thus the fastening of the casting machine 10 to the carriage 3 of the bridge crane 1, and respectively the dismounting of the casting machine from the carriage, is a quick and easy operation.

The lower frame 12 of the casting machine 10 is designed so that in the upper part thereof, there is arranged a horizontally extending portion 13 provided with a pin or bar 14, which the lifting hook of the bridge crane 1 can grip. Thus, by vertical motion of the lifting hook 6 of the bridge crane 1, there is achieved vertical motion of the lower frame 12 of the casting machine 10 in relation to the upper frame 11, fastened to the bridge crane carriage 3 by intermediation of the auxiliary element 20.

In the area of the lower end of the lower frame 12 of the casting machine 10, there is attached a casting mix container 15, which is provided with means 16 for opening and closing the pouring gate located on the bottom of the casting mix container. In connection with the casting mix container 15, there also are provided hydraulic means 17 for rotating the casting mix container around its vertical axis, and for operating the means 16 in order to open and close the pouring gate.

By combining the control system 25 of the casting machine 10 according to the invention, illustrated in the drawing, with the control system of the bridge crane 1, the control system 25 of the casting machine can be easily automated and connected, through the casting machine automatics, to a wider automatic system, for example to a system controlling the whole concrete factory. Now this control system is used for horizontally and vertically controlling the moving operations of the casting machine 10, produced by the motions of the bridge crane 1, in addition to which the control system is used for controlling the rotation of the casting mix container 15 around the vertical axis, as well as the hydraulic means 17 controlling the opening and closing means 16 of the pouring gate. This kind of combining and automation of the control systems can be realized in obvious ways and means known to a person skilled in the field of control automatics.

The structure of the casting machine 10 according to an embodiment of the invention, to be dismountably attached to a crane, illustrated schematically in the drawing, is remarkably simpler than the structure of conventional casting machines to be attached to cranes, which casting machines are provided with separate motors for creating the vertical motion. This simpler structure makes it possible to reduce the weight of the casting machine even by half of the weight of known casting equipment, which results in considerable material savings and hence savings in the production expenses when manufacturing casting machines. Moreover, the energy consumption of the casting machine itself is substantially reduced, even down to a fifth in comparison with prior art casting machines, when the crane can be utilized in creating the vertical motion of the casting machine.

The invention is not restricted to the above described embodiment, also illustrated in the drawing, but it can be modified in ways obvious to a person skilled in the art, within the scope of the appended claims.

The invention claimed is:

1. A method for controlling concrete mix casting equipment, wherein the concrete mix casting equipment:

includes a pouring gate;

is dismountably attached to a crane;

has a horizontally movable crane carriage, an auxiliary element fixedly attached to the horizontally movable crane carriage, a two-part frame comprising an upper frame that is dismountably attached to the auxiliary element and a lower frame that is slidably attached to the upper frame in a vertically adjustable fashion, and a lifting element comprising a lifting hook, and a concrete mix container attached to the lower frame, and wherein the method comprises:

controlling a motion of the casting equipment in a horizontal plane by moving the crane, or the crane carriage and the auxiliary element fixedly attached to the crane carriage, or both, in a horizontal direction, and controlling a substantially vertical motion of the pouring gate of the casting equipment, during the operation of the casting equipment, by vertically moving the lifting element of the crane, such that the lifting hook engages an upper part of a lower frame of the casting equipment, wherein the substantially vertical motion of the lower frame results from vertical sliding of the lower frame relative to an upper frame, thereby moving the lower frame of the casting equipment vertically relative to the upper frame of the casting equipment, which upper frame is dismountably attached to the auxiliary element.

2. The method according to claim 1, wherein the crane is a bridge crane, and the casting equipment is dismountably attached to the auxiliary element fixedly attached to the bridge crane carriage.

3. The method according to claim 1, wherein the crane and the concrete mix casting equipment are controlled by the same control system.

4. A concrete mix casting equipment to be dismountably attached to a crane having a crane carriage and a lifting element comprising a lifting hook, comprising:

a concrete mix container, a pouring gate for conducting the concrete mix from the container to the casting mold, an auxiliary element fixedly attached to a carriage of the crane, a two-part frame, comprising an upper frame that is dismountably attached to the auxiliary element, and a lower frame that is slidably attached to the upper frame in a vertically adjustable fashion, and wherein the concrete mix container is attached to the lower frame, wherein the lower frame is connectable to the lifting element of the crane, thereby producing vertical motion of the pouring gate during the operation of the casting equipment when the lifting element of the crane is moved in a vertical direction.

5. The concrete mix casting equipment according to claim 4, wherein the crane is a bridge crane, and the casting equipment is dismountably attached to the auxiliary element fixedly attached to the bridge crane carriage.

6. The concrete mix casting equipment according to claim 4, wherein the concrete mix container comprises the pouring gate.

7. The casting equipment according to claim 4, wherein an automatic control system controls the crane and the casting equipment.

* * * * *